United States Patent [19]

French

[11] 4,216,659

[45] Aug. 12, 1980

[54] THERMAL SYSTEM

[76] Inventor: Roger F. French, P.O. Box 158, Jackson, N.H. 03846

[21] Appl. No.: 3,631

[22] Filed: Jan. 15, 1979

[51] Int. Cl.[3] ..... F25B 27/02

[52] U.S. Cl. ..... 62/186; 62/238; 62/324

[58] Field of Search ..... 237/2 B; 62/238 E, 324 D, 62/186

[56] References Cited

U.S. PATENT DOCUMENTS

| | | | |
|---|---|---|---|
| 2,125,842 | 8/1938 | Eggleston | 62/238 X |
| 2,257,975 | 10/1941 | Miller et al. . | |
| 2,575,325 | 11/1951 | Ambrose et al. | 62/238 X |
| 2,619,326 | 11/1952 | McLenegan | 62/238 X |
| 2,632,306 | 3/1953 | Ruff | 62/238 X |
| 2,690,649 | 10/1954 | Borgerd | 62/238 X |
| 2,751,761 | 6/1956 | Borgerd | 62/238 |
| 2,860,493 | 11/1958 | Capps et al. . | |
| 3,188,829 | 6/1965 | Siewart et al. | 62/160 |
| 3,916,638 | 11/1975 | Schmidt | 62/238 |

*Primary Examiner*—William E. Wayner

*Attorney, Agent, or Firm*—Norman S. Blodgett; Gerry A. Blodgett

[57] ABSTRACT

Thermal system which simultaneously collects heat from waste water and from the dehumidification of a living space and utilizes the heat thus collected to heat water; the transfer of heat is accomplished by a heat exchange medium circulating in a closed loop system.

12 Claims, 2 Drawing Figures

THERMAL SYSTEM

BACKGROUND OF THE INVENTION

The present invention relates to a water heating system. Present domestic and commercial water heaters utilize electricity or fossil fuels for the heating water. Due to the increasing cost of electricity, both of these sources of heat are becoming increasingly more expensive. In addition, the increased burning of fuel and generation of electric power has become a serious environmental problem. In spite of a greater capacity for generating electric power, the demand for power is outstripping our capacity to produce it. Industry is heavily dependent on electric power, while the domestic use of power has increased due to labor-saving devices in the home, air conditioners, and other appliances.

While power consumption has increased, there is a corresponding increase of power waste. This waste, for the most part, is in the form of heat. After heated water has served its intended purpose, it is disposed of into a sewage system. In the generation of electricity, as well as its utilization for operating appliances and machines, heat is an unused by-product and wasted BTUs are dumped into the environment.

It is, therefore, an outstanding object of the invention to provide a water heating system which utilizes heat that would, otherwise, be wasted.

Another object of the invention is the provision of a thermal system for warming water at a substantial savings in operating costs.

A further object of the invention is the provision of a thermal system for heating water in which system there is a substantial reduction in environmental pollution, i.e., thermal pollution of streams and chemical pollution of air.

It is another object of the instant invention to provide a thermal system for heating water with improved heat-transfer capability by using the phase-change of a heat transfer fluid.

A still further object of the invention is the provision of a thermal system which utilizes a minimum of moving parts.

It is a further object of the invention to provide a thermal system for heating water which is relatively simple and reliable to operate.

It is a still further object of the present invention to provide a thermal system for heating water, the system including automatic controls which enable it to function within optimum temperature ranges for maximum operating efficiency.

Another object of the invention is the provision of a thermal system for heating water wherein heat is collected from its hottest point and is transferred to the water to be heated at its coldest point as a further enhancement of operating efficiency.

Another object of the invention is the provision of a thermal system which combines in a single unit the collection of waste heat from two unrelated heat waste sources.

Another object of the invention is the provision of a thermal system for heating water in which a single heat collection unit collects heat from waste water and heat from an air conditioning or dehumidifying system.

With these and other objects in view, as will be apparent to those skilled in the art, the invention resides in the combination of parts set forth in the specification and covered by the claims appended hereto.

SUMMARY OF THE INVENTION

In general, the invention comprises a thermal system for hot water heating in which a heat exchange tank is provided for receiving warm waste water and is provided with an evaporator vessel, which is connected to a condensing coil located in a hot water storage tank in a closed looped system. Means is provided for passing air to be dehumidified across the evaporator vessel and for circulating a refrigerant or heat exchange medium within the closed loop system, so that the refrigerant enters one end of the evaporator vessel as a liquid and exits at the other end as a vapor. The refrigerant enters the condensing coil in the storage tank as a vapor and exits therefrom as a liquid. Heat is thereby extracted from the waste water in the heat exchange tank and from the air being passed across the evaporator vessels, while simultaneously dehumidifying the air. The extracted heat is then transferred to the water in the hot water tank.

More specifically, the evaporator vessel is in the form of a hollow jacket surrounding the heat-exchange tank or, alternately, in the form of a coil surrounding the tank. The means for passing air across the evaporator vessel for dehumidification consists of a shroud surrounding the evaporator vessel. The shroud has an inlet opening, an outlet opening, and a fan for creating an air flow through the shroud from the inlet opening. The resulting precipitation from the shroud is collected in a vessel located adjacent the inlet opening of the shroud and combined with the waste water discharge from the heat-exchange tank for eventual discharge to a sewage system. Means for circulating the refrigerant in the closed-loop system comprises a compressor for drawing vaporized refrigerant from the evaporator vessel and forcing the vaporized refrigerant into the condensing coil. Electrical control means are provided for operating the thermal system in response to temperature-sensing elements in the hot water storage tank and the heat-exchange tank.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
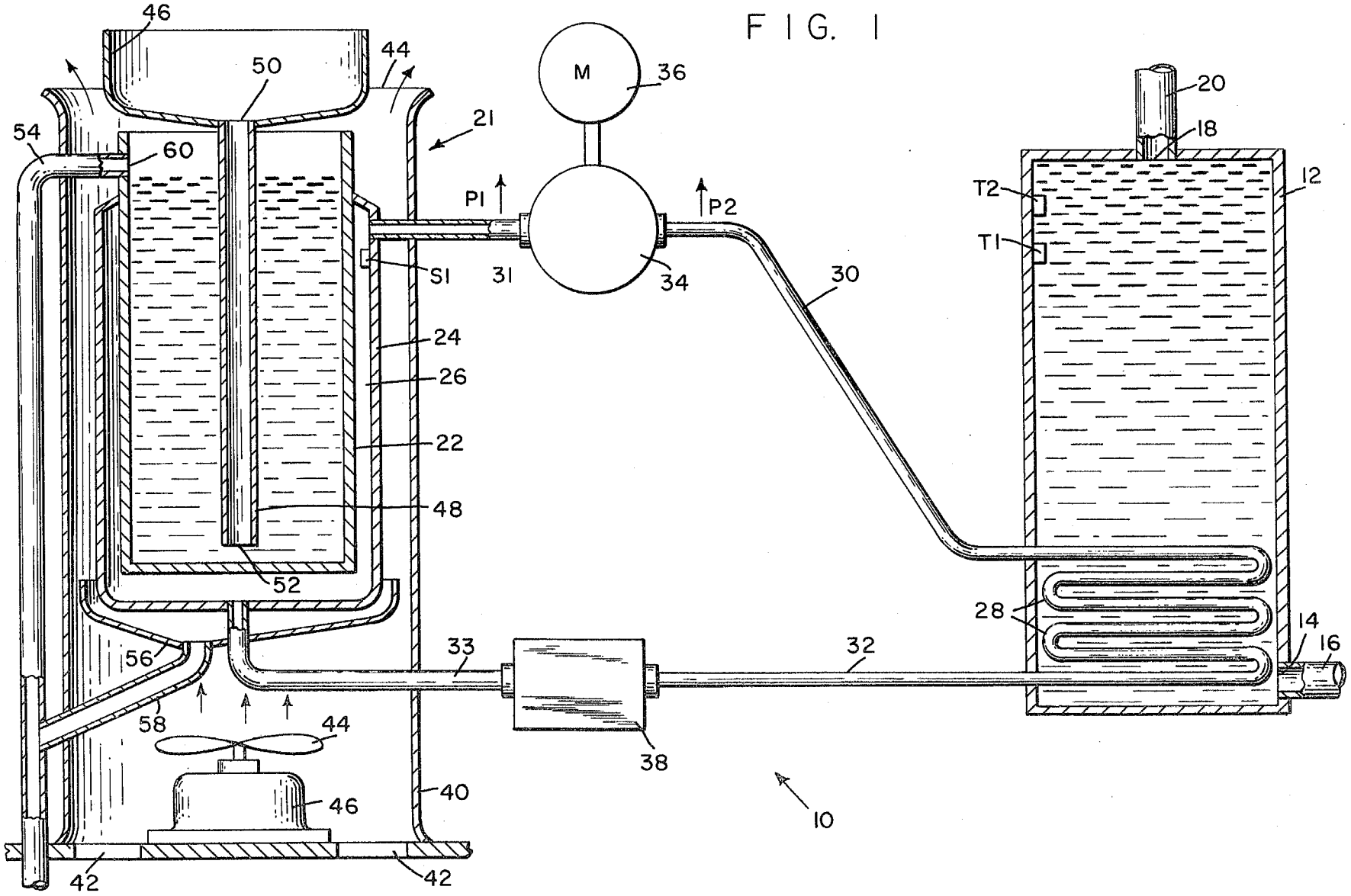
FIG. 1 is a schematic view of an apparatus embodying the principles of the present invention.

Referring to FIG. 1, which best shows the general features of the invention, the thermal system for hot water heating, indicated generally by the reference numeral 10, comprises a hot water storage tank 12 having an inlet opening 14 connected to a water inlet pipe 16 and an outlet opening 18 connected to a water outlet pipe 20. A heat exchange unit, generally indicated by the reference numeral 21, is located at a point spaced from the hot water tank. Heat exchange unit 21 comprises a storage tank 22 for warm waste water. An evaporator vessel in the form of a jacket 24 surrounds the storage tank 22 and defines with tank 22 a hollow annular spaced 26 which surrounds the bottom and side portions of the tank 22. A condensing coil 28 is located in the lower portion of the hot water tank 12. A compressor 34 driven by a motor 36 is connected to the upper portion of space 26 by means of a pipe line 31 and to the upper end of condensing coil 28 by means of pipe line 30. The lower end of condensing coil 28 is connected to a metering valve 38 by a pipe line 32. A pipe line 33 connects to opposite end of metering valve 38 to the lower portion of space 26. Space 26, coil 28, compressor 34, expansion valve 38, and pipe lines 30–33 all forming a closed loop system which contains a liquid heat transfer medium such as freon. This system represents a simple vapor-compression cycle used in typical home refrigerators.

The storage tank 22 and jacket 24 is enclosed within an annular shroud 40 having a bottom inlet opening 42 and an upper outlet opening 44. A fan 46 driven by a motor 48 is located within inlet opening 42 for creating an air stream within the shroud 40 from the inlet opening 42 toward the outlet opening 44. The ambient air to be dehumidified is drawn into opening 42 and discharged out of opening 44.

Storage tank 22 contains waste water received from a collector 46 located at the top of the tank which delivers the waste water to the bottom of tank 22 by means of a vertical pipe 48. The pipe 48 has an upper inlet opening 50 connected to the bottom of the collector 46 and a lower outlet opening near the bottom of heat-exchange tank 22. A drain pipe 54 is connected to the upper portion of the tank 22 and extends to a point below the tank 22 to a sewage discharge, not shown. A precipitation collector 56 is located below jacket 24 and is connected to drain pipe 54 by means of a branch drain pipe 58.

GENERAL OPERATION

The operation and advantages of the invention will now be readily understood in view of the above description. During operation of the system 10, heat is derived from waste water, and from dehumidification of air and transferred to the hot water storage tank 12. Compressor 34 creates a low pressure P1 in line 31 and a relatively higher pressure P2 in line 30. This draws the heat-transfer medium in the vapor state from space 26 and forces it through line 30 into coil 28 where it condenses into a liquid state. The latent heat of vaporization resulting from the conversion of the heat exchanged medium from the vapor state to the liquid state is thereby transferred to the relatively cold water in the bottom of storage tank 12. As the water in the tank is heated, it rises toward the top of the tank where it is drawn off through pipe 20 and replaced by cold water entering from pipe 16. The heat-exchange medium from condensing coils 28 is forced into expansion valve 38 from pipe 32 as a high pressure liquid. Expansion valve 38 is preferably in the form of a long capillary tube. The pressure of the liquid is decreased as it flows through the expansion valve and, as a result, some of the liquid flashes into vapor into space 26 from pipe line 33. The remaining liquid, now at low pressure, is vaporized in space 26 as a result of heat transfer. The heat-exchange medium absorbs heat from the warm waste water in the tank 22 and also absorbs heat from air passing along the outside of jacket 24 as a result of the air flow through shroud 40 created by fan 44. The transfer of heat from the ambient air passing along the outer surface of jacket 24 cools the air, causing moisture to precipitate from the air so that as the air exits from opening 44 of the shroud it is both cooled and dehumidified. The precipitation is collected in precipitation collector 56 from which it flows into drain pipe 54 by branch drain pipe 58. As additional warm waste water enters the heat-exchange tank 22 from the lower outlet opening 52 of pipe 48, water tank 22 which has already lost most of its heat is displaced through an overflow opening 60 into drain pipe 54. The vaporized heat-exchange medium in space 26 after having absorbed heat from the waste water and air flowing through shroud 40 is extracted from space 26 by compressor 34 and forced into coil 28 through line 30, thereby transferring the heat collected from the heat-exchange tank to the water in the water tank 12, as it condenses to a liquid in the coil 28, and thereby completing the heat-exchange cycle.

ELECTRICAL CONTROLS

Figure 2:
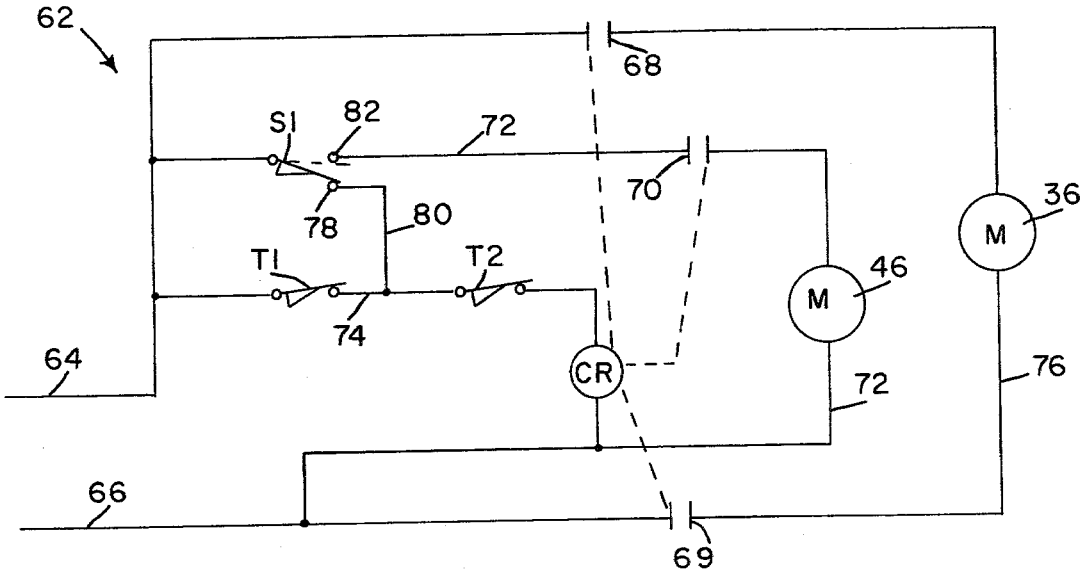
FIG. 2 is a schematic view of an electric control means for the invention.

Referring particularly to FIG. 2, there is shown a schematic control circuitry, generally indicated by the reference numeral 62, and including a pair of power lines 64 and 66. The control circuitry is used so that the thermal system does not run continuously, but only under those conditions the system operates most efficiently in transferring heat from in and around the exchange tank to the hot water tank. The control circuitry also insures that the various power components are not continuously stopped and started for every change in operating conditions, but to operate only within predetermined temperature range.

The motor circuitry is actuated by energizing relay CR which when energized closes normally open contacts 68, 69, and 70 on lines 64, 66, and 72, respectively. A pair of thermostat switches T1 and T2 are located within the hot water tank 12 and are located on line 74, switch T1 closes when the water temperature falls below 130° F. and switch T2 closes when the water temperature falls below 150° F. When both switches are closed a circuit is completed from power line 64 to power line 66 across power line 74 so that control relay CR located on line 74 is energized. Upon energization of relay CR, its normally open contacts 68 and 69 are closed, thereby energizing compressor motor 36. Energization of motor 36 causes circulation of the heat exchange medium for transferring heat from the waste water in the tank 22 to the hot water tank 12. A third switch S1 which has two operating positions is located in jacket 24. For temperatures above 50° F., switch S1 is in the position shown in FIG. 2 in contact with a pole 78 on a line 80 which is connected to line 74. For temperatures below 50° F. switch S1 is in its second operating position shown in dotted lines in FIG. 2 in contact with a pole 82 on line 72. In the second operating position, switch S1 connects line 72 to power line 74 and thereby energizes motor 46 to operate the fan 44, thereby actuating the dehumidifying portion of the heat exchange system. Moreover, when switch S1 is in its first operating position in contact with pole 78 and the water temperature in hot water tank 12 is between 130° and 150° in which case switch T1 is open. Current will continue to be drawn across line 74 via line 80, thereby maintaining control relay CR energized and contacts 68 and 69 closed, so that motor 36 continues to run. When the water temperature in tank 12 is above 150°, switches T1 and T2 both open thereby deenergizing relay CR. Upon deenergization of control relay CR, contacts 68 and 69 open and motor 36 shuts off which stops the circulation of the heat exchange medium.

It is to be understood that the above specific temperatures are only used as examples. The specific temperatures will vary with various applications of the invention and the particular requirements of the user. If desired, a pressure switch could be used in place of thermostat switch S1 in the control circuitry. The pressure switch would be located in pipe line 31 for measuring the pressure P1 would operate in the same manner as switch S1 in that it would be in its first operating position as shown in FIG. 2 in contact with pole 78 when the pressure P1 in pipe 31 is below a predetermined value and in the second operating position in contact with pole 82 when the pressure P1 in pipe 31 is above this value.

The advantages of the present invention will now be understood in view of the above description.

The system is such that one kilowatt-hour of mechanical power can transverse several kilowatt-hours of heat. Considering the dehumidification process by itself in the absence of warm waste water, the coefficient of performance of the system is expressed by the following relationship:

$$C.O.P.=(T_H \times PR)/(T_H - T_C)$$

where

C.O.P. is coefficient of performance $T_C$=Temperature of cold surface which receives heat $T_H$=Temperature of hot surface which rejects PR=Practical realization factor of system For a dehumidifier temp of 40° F. and a hot water temperature of 140° F., the expected temperatures of the fluids would be 30° F. Converting to absolute temperatures, this is 460+30 or 490° Rankine and 150+460 or 610° Rankine. Substituting these values in the formula $$C.O.P.=610/(610-490)=610/120=5.08$$
theoretical, assumming an 70% practical realization factor the above becomes $$5.08 \times 0.70=3.556$$

This means that every kilowatt-hour of electricity used will transfer 3.556 kilowatt-hours of heat to the water. Thus, if 6000 kilowatt-hours of electricity are used in the home to heat hot water, the same amount of hot water could be heated by only 1687 KWH of electricity using the above system.

In the spring, summer, and fall a typical home has excess moisture and this removal of humidity contributes to the comfort of the home. In the winter time there may be insufficient moisture and the system will remove heat from the room containing the heat pump system.

By combining dehumidification with heat recovery from the waste water in the home, even greater benefits are obtained. The waste water includes water from the dishwasher, clothes washer, bath and shower, kitchen sink, and a lavatory.

Referring to the previous formula, when the hot water is discharged from the dishwasher or shower, the temperature in the heat recovery tank would typically be raised to an average temperature of 80° F. while the water in the bottom of the hot water tank would be reduced to an average temperature of 120°. With 10° for heat transfer. Referring to the previous formula:

$$T_C=80-10+460=530° \text{ Rankine}$$

$$T_H=120+10+460=590$$

$$C.O.P.=590/(590-530)\times 0.7=6.88$$

Thus, while recovering heat from the waste water we have an increase of coefficient of performance of up to 6.88.

The above combination of a heat pump system heat recovery from waste water, and a dehumidifier represents a very synergistic combination of technology to provide hot water in homes and light industry. This can provide a dramatic decrease (by a factor of greater than 3) in the use of electricity. Hot water represents one of the largest uses of energy for our society and this system provides great savings. This provides for significant reduction in the use of our dwindling supply of oil and natural gas. It thus further reduces the deterioration of our environment by replacing the less efficient systems for heating hot water currently used.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Thermal system for hot water heating comprising:

(a) a hot water storage tank having an inlet opening for receiving cold water and an outlet opening for the exit of heated water, (b) a heat exchange unit comprising a storage tank for receiving warm waste water and discharging cooled waste water, (c) an evaporator vessel comprising a hollow jacket surrounding the waste water storage tank, (d) a condensing coil located within the hot water storage tank and connected to the evaporator vessel in a closed loop system, (e) a refrigerant fluid contained within the evaporator vessel and condensing coil, (f) means for passing air to be dehumidified across the evaporator vessel, and (g) means for circulating the refrigerant fluid within the closed loop system, so that the fluid enters one end of the evaporator vessel as a liquid and exits as a vapor, and enters the condensing coil as a vapor and exits therefrom as a liquid.

2. Thermal system as set forth in claim 1, wherein the heat exchange unit comprises:

(a) an outlet opening located at the upper portion of the storage tank, (b) a drain pipe connected to the outlet opening, (c) a receiver for waste water located above the storage chamber, and (d) a pipe connected to the receiver and extending to the bottom of the chamber for conveying waste water from the receiver to the bottom of the tank.

3. Thermal system as set forth in claim 1, wherein the means for passing air across the evaporator vessel comprises:

(a) a shroud surrounding the evaporator vessel, the shroud having an inlet opening and an outlet opening, and (b) a fan for creating an airflow through the shroud from the inlet opening.

4. Thermal system as set forth in claim 3, comprising a collector located adjacent the inlet opening of the shroud for collecting precipitation resulting from the dehumidification of air passing through the shroud.

5. Thermal system as set forth in claim 4, comprising means for conveying the precipitation from the collector and combining it with the waste water discharged from the heat exchange tank.

6. Thermal system as set forth in claim 1, wherein the refrigerant fluid is freon.

7. Thermal system as set forth in claim 1, wherein the closed loop system comprises an upper conduit connecting the upper portion of the evaporator vessel to the upper portion of the condensing coil and a lower conduit connecting the lower portion of the evaporator vessel to the lower portion of the condensing coil and the means for circulating the refrigerant fluid comprises a compressor located in the upper conduit for drawing vaporized refrigerant from the evaporator vessel and forcing the vaporized refrigerant into the condensing coil.

8. Thermal system as set forth in claim 7, comprising an expansion valve in the lower conduit.

9. Thermal system as set forth in claim 7, wherein the compressor is driven by an electric motor connected to electrical control means comprising:

(a) a first switch for sensing water temperature in the hot water tank, said first switch being closed by temperature below a first temperature, (b) a second switch for sensing water temperature in the hot water tank, said second switch being closed by temperatures below a second temperature which is higher than said first temperature, said second switch being connected in series with said first switch so that the electric motor is closed when said first and second switches are closed, and (c) a third switch for sensing temperature in the evaporator vessel which is effective to bridge said first switch when the sensed temperature is the evaporator vessel falls below a third temperature so that the electric motor will be energized when the second temperature in the hot water tank is between said first and second temperature and the sensed temperature in the evaporator vessel is below said third temperature, thereby activating the dehumidification system.

10. Thermal system as set forth in claim 9, wherein the fan is driven by second electric motor and the third switch is a double pole switch and connected to the second electric motor so that said second electric motor is energized for sensed temperatures at and above said third temperature.

11. Thermal system for hot water heating comprising:

(a) a hot water storage tank having an inlet opening for receiving cold water and an outlet opening for the exit of heated water, (b) a heat exchange unit for receiving warm waste water and discharging cooled waste water, (c) an evaporator vessel associated with the heat exchange unit, (d) a condensing coil located within the hot water storage tank and connected to the evaporator vessel in a closed loop system, comprising an upper conduit connecting the upper portion of the evaporator vessel to the upper portion of the condensing coil and a lower conduit connecting the lower portion of the evaporator vessel to the lower portion of the condensing coil, (e) a refrigerant fluid contained within the evaporator vessel and condensing coil, (f) means for passing air to be dehumidified across the evaporator vessel, (g) a compressor located in the upper conduit for circulating the refrigerant fluid within the closed loop system for drawing vaporized refrigerant from the evaporator vessel and forcing the vaporized refrigerant into the condensing coil, (h) an electric motor for driving the compressor and connected to electrical control means comprising a first switch for sensing water temperature in the hot water tank, said first switch being closed by temperatures below a first temperature, a second switch for sensing water temperature in the hot water tank, said second switch being closed by temperatures below a second temperature which is higher than said first temperature, said second switch being connected in series with said first switch so that the electric motor is closed when said first and second switches are closed, and a third switch for sensing temperature in the evaporator vessel which is effective to bridge said first switch when the sensed temperature in the evaporator vessel falls below a third temperature so that the electric motor will be energized when the second temperature in the hot water tank is between said first and second temperatures and the sensed temperature in the evaporator vessel is below said third temperature, thereby activating the dehumidification system.

12. Thermal system as set forth in claim 11, wherein the fan is driven by second electric motor and the third switch is a double pole switch and connected to the second electric motor so that said second electric motor is energized for sensed temperatures at and above said third temperature.

* * * * *